United States Patent [19]

Cardiff

[11] Patent Number: 4,561,265

[45] Date of Patent: Dec. 31, 1985

[54] AIR CIRCULATION SYSTEM

[75] Inventor: Raymond S. Cardiff, Macgregor, Australia

[73] Assignee: Cardiff's Pty Ltd., Australia

[21] Appl. No.: 576,652

[22] Filed: Feb. 3, 1984

[51] Int. Cl.[4] ..... F25D 17/06

[52] U.S. Cl. ..... 62/419

[58] Field of Search ..... 62/419

[56] References Cited

U.S. PATENT DOCUMENTS 3,412,571 11/1968 Bolynn ..... 62/419 X
3,521,459 7/1970 Rath ..... 62/419 X
3,638,449 2/1972 Lichtenberger ..... 62/419 X
4,474,020 10/1984 Freeman ..... 62/419 X

*Primary Examiner*—Lloyd L. King
*Attorney, Agent, or Firm*—Sughrue, Mion, Zinn, Macpeak, and Seas

[57] ABSTRACT

Air circulation system having a multi bladed radial fan supported within a venturi is provided. The fan is located within an aperture in a plenum chamber and the chamber has an outlet through which chilled air may be ejected. Refrigerant coils are located adjacent the outlet of the chamber so that air is drawn from the room into the plenum chamber by the fan and forced across the coils and returned as chilled air into the room.

6 Claims, 4 Drawing Figures

AIR CIRCULATION SYSTEM

This invention relates to improvements in and relating to air circulator systems and means therefor which are particularly but not exclusively suitable for coldrooms and chillers, freezers, blast freezers and the like.

For illustrative purposes only, reference will hereinafter be made to the present invention in relation to chillers for the temporary storage of the caracasses of freshly slaughtered beasts. Of course, the invention is not limited to such applications.

In a typical chiller a batch of carcasses supported on overhead conveying means is introduced to the chiller at for example, 90° F. for chilling to a holding temperature of for example, 30° F. These carcasses are held in the chiller for a period of approximately eight hours, ideally to ensure complete and even chilling of all the carcasses. In practice this is rarely achieved. Uneven chilling can result in loss of product and increased butchering costs during later processing of carcasses. Furthermore, if the humidity conditions within the chiller can not be maintained at an optimum value, meat shrinkage will occur if the moisture level is too low with obvious loss of product and if the moisture level is too high, either throughout the chiller or in isolated pockets within the chiller, moisture build up can result in the spoiling of some of the carcasses.

At present, chillers employ an air circulation system utilizing high flow velocity axial flow fans to circulate cold air through the chiller. It has been found that such air circulation means have certain deficiencies. The operating characteristic of such fans is that they have the ability to shift large quantities of air provided the pressure differential across the fan is maintained within a relatively small range. When the pressure differential increases, such as a result of an increase in resistance to air flow, then the fan blades slip and the power supplied to the fan is not converted into air flow. As the air flow restriction increases the volume of air discharged by the fan decreases until, in the extreme, the fan simply rotates at high speed without causing air circulation. Furthermore, since the fans utilized are axial flow fans the air flow to or from the fans is at a high velocity and is unidirectional to a large extent. In service an air flow pattern tends to be established whereby tracking occurs between the fans and the inlet/outlet depending upon whether an induced or forced draft circulation of cold air is used. As a result there are many zones or pockets within the chiller at which the air flow is either stagnant or ineffective whereby carcasses stored in those particular locations are not adequately chilled.

In a typical installation, a plurality of axial flow fans are used to force air through refrigerated coils. The coils are located adjacent a respective fan so that the air flow first passes across the coils before discharging as cold air into the chiller.

In use wet carcasses from a washing room are introduced into the chiller and as the carcasses are chilled the moisture from the carcasses tends to build up as ice on the refrigerant coils and the resultant restriction in air flow reduces the effectiveness of the operation of the axial fans, i.e., the fans begin to slip and there is consequent reduction in air flow. To this end relatively large powerful axial fans are presently used to compensate for this slipping of the fans and this adds further to the running costs both in relation to the electricity consumption for driving the electric fans and the refrigerant capacity required to cope with the additional heat loads imposed by the large electric motors. These and other disadvantages of the present chillers add significantly to the cost of processed meat.

It is an object of the present invention to alleviate the disadvantages set out above and to provide an air circulation system which will be reliable and efficient in use. Other objects and advantages of the present invention will hereinafter become apparent.

With the foregoing and other objects in view, this invention in one aspect provides an air circulation system for circulating air in a chamber or room including:

(a) a multi-bladed radial fan supported within a venturi;

(b) a plenum chamber along the wall of the chamber or room, the plenum chamber having an aperture within which said fan is mounted and an outlet through which chilled air may be ejected;

(c) refrigerant coils for conveying refrigerant mounted inside said plenum chamber and adjacent said outlet whereby air is drawn from the chamber or room into said plenum chamber by said fan, forced across said coils and returned as chilled air into said chamber or room through said outlet.

Preferably, the fan is arranged so as to induce air flow thereto in a plurality of directions including in a radial direction. Since the inlet pressure falls with flow circulation resistance it is also preferred that the back pressure at the fan outlet is minimized by maintaining a free air flow path from the fan for a selected distance. Suitably this distance is equal to or greater than the diameter of the fan.

A fan assembly useful in the system of the invention may include a multi-bladed fan supported for rotation within a venturi having a throat which flares outwardly to provide an enlarged air inlet and the fan blade is selectively positioned in relation to said outwardly flared throat whereby a significant proportion of the air flow through said fan is induced into said inlet in a radial direction. In a preferred form the fan has the following characteristics.

| Dimension Number | Description | Typical Example | Preferred Typical Range (expressed at % of dimension 1 where applicable) |
|---|---|---|---|
| 1. | Venturi Opening Diameter | 923 mm | — |
| 2. | Fan diameter | 904 mm | — |
| 3. | Tip Clearance | 9 mm | (0–10)% |
| 4. | Blade Number | $4^{10}$ | 2–12 |
| 5. | Blade Pitch | 35° | 10°–60° |
| 6. | Axial length of Venturi | 85 mm | (5–30)% |
| 7. | Axial length of cylindrical portion of venturi | 30 mm | (1–10)% |
| 8. | Venturi flare radius | 55 mm | (2–20)% |
| 9. | Axial spacing of leading edges of blades from face of venturi | 5 mm | (0.1–5)% |
| 10. | Blade Curvature Radius | 360 mm | (20–60)% |

In order that the invention may be more readily understood and put into practical effect, reference will now be made to the accompanying drawings which illustrate various aspects of the present invention and wherein.

Figure 1:
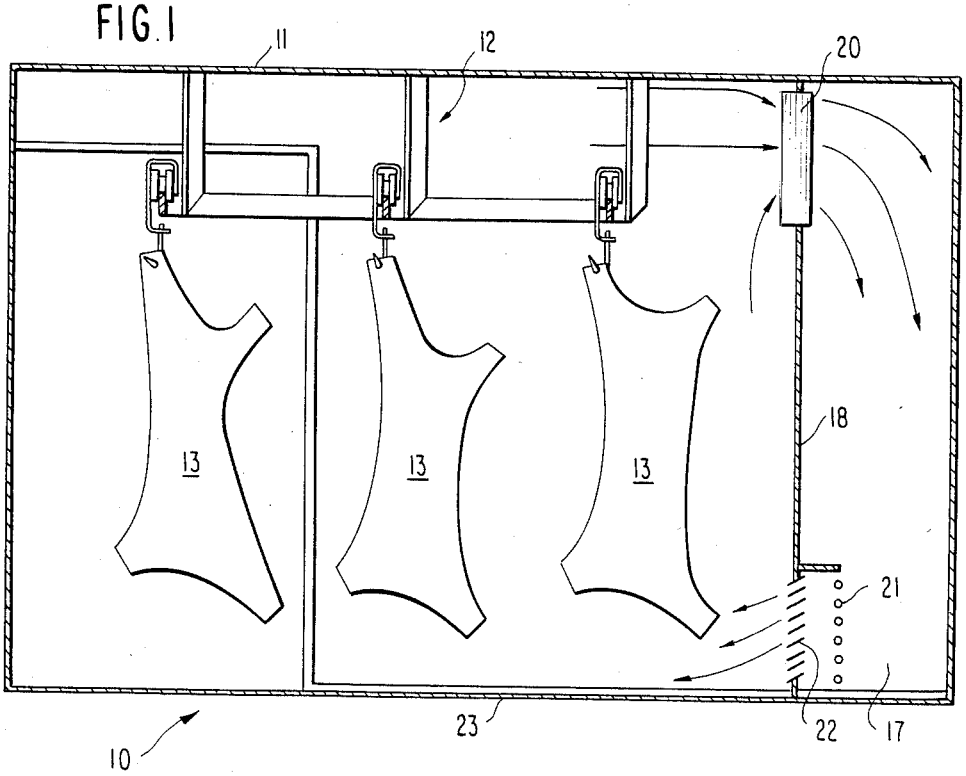
FIG. 1 is a diagrammatic cross-sectional view illustrating a preferred embodiment of a chiller made in accordance with one aspect of the present invention.

As shown a chiller 10 made in accordance with the present invention includes an insulated rectangular housing 11 having a suspended conveyor system 12 from which a plurality of carcasses 13 may be hung. The conveyor system 12 leads into the housing 11 from a door at one end and extends circuitously to form three runs 14, 15 and 16 the latter of which exits from a further door at the opposite end of the housing 11.

A plenum chamber 17 is formed adjacent one side wall 18 which is common to the housing 11 and the chamber 17. In order to cause cold air to circulate about the carcasses in the chiller, there is provided air extraction apparatus 20 adjacent the top of the wall 18 and a refrigerated coil 21 which is adapted to communicate with the housing 11 through an outlet grill 22. The grill 22 is adapted to direct air flowing there through downwardly towards the floor 23 of the housing 11 whereby it is distributed throughout the housing, the relatively even distribution of the cold air being assisted of course by the multi-directional air extraction apparatus 20. The placement of the outlet grill 22 adjacent the floor is also effective in preventing the formation of condensation within the chiller. However in a freezer or blast freezer it may be preferable to locate the fan adjacent the floor of the plenum chamber with the outlet, grill and refrigerated coil adjacent the top of the plenum chamber. In earlier chillers which utilize high cold air outlets the cold air impinging on the metal support structure for the conveyor frequently resulted in the formation of moisture on the metal which could drip on the carcasses. Preferably the ratio of the intake area of the air extraction apparatus to the outlet area of the outlet grill 22 is 1:1 but of course this may be vary between 1:1 and 1:1.3.

Figure 2:
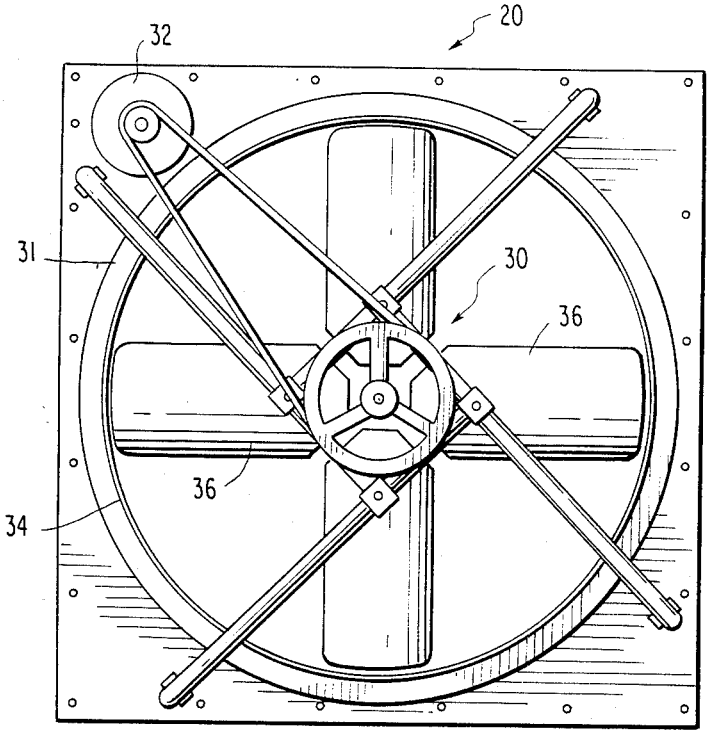
FIG. 2 is a plan view of a fan assembly according to the present invention.
Figure 3:
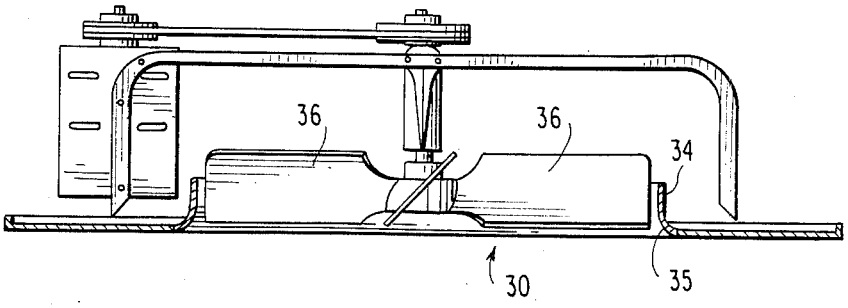
FIG. 3 is a partial cross-sectional view of the fan assembly showing placement of the fan blade in relation to the venturi-like housing.
Figure 4:
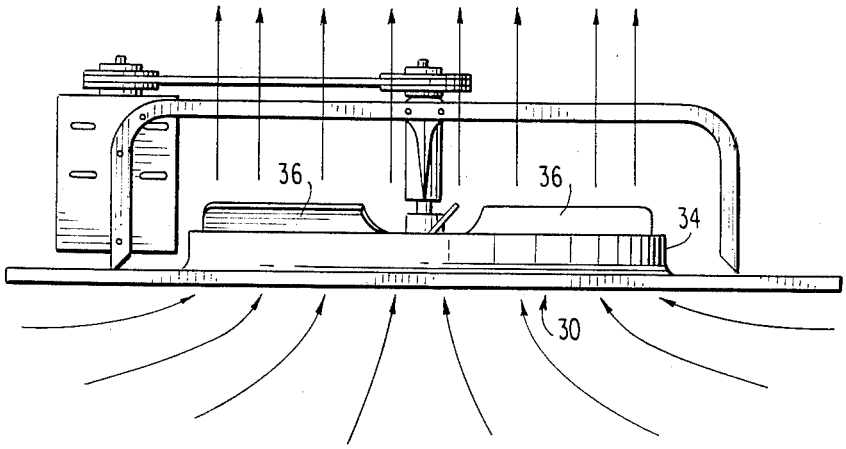
FIG. 4 is a view similar to FIG. 3, but illustrating air intake flow directions.

The multi-directional air extraction apparatus 20 utilized in this embodiment is illustrated in FIGS. 2 to 4. It will be seen that the apparatus 10 in this embodiment includes a four bladed fan 30 supported for rotation within a venturi 31. The fan 30 is belt driven by a relatively low powered electric motor 32 supported outside the venturi 31. Preferably the fan rotates at a speed less than 1000 r.p.m.

It will be seen from FIG. 3, that the venturi includes a rear cylinderical part 34 and an outwardly flared or bell mouthed portion 35. The fan 30 is adapted to be rotated relatively slowly at about 300–400 r.p.m. and in order to achieve the desired mass flow rate the fan blades 36 are set to a high pitch such as approximately 45° and the blade area is large.

It has been found that the placement of the blade 30 within the venturi can be arranged so that the fan assembly will exhibit multi-directional air inlet characteristics including a large inflow in a direction substantially radially of the venturi 31. In particular this is achieved by selective axial positioning of the fan 30 within the venturi 31. If the fan is moved back too far in the venturi it will become an axial flow fan and of course if it is moved too far forward in the venturi the latter will cease to assist in efficient operation of the fan.

By way of comparison the above described air extraction apparatus would be effective in replacing a conventional high speed axial flow fan powered by a much more powerful motor, such as a seven horsepower motor.

Since the air extraction apparatus 20 continues to shift air even when the pressure differential across the fan increases by the build up of ice on the refrigerant coil, the latter build up will be minimized so that a relatively humid condition will be maintained in the chiller.

This may result in a percentage reduction in weight from the order of two to three percent to one or less percent.

In a further embodiment, air extraction apparatus has a variable speed fan controlled automatically by sensing means within the chiller whereby the speed of rotation of the fans may be reduced after an initial chilling period and stepwise reduced thereafter according to demand for refrigeration. This will achieve further economies of operation.

The claims defining the invention are as follows:

1. An air circulation system for circulating air in a chamber or room, the system including:

a plenum chamber extending along one wall of the room, said plenum chamber having an inlet aperture and a spaced outlet aperture;

a venturi defining an opening and located in said inlet aperture, said venturi including a rear cylindrical part within said plenum chamber and an outwardly flared bell mouthed part terminating in an outer edge;

a multi-bladed radial fan supported within the venturi for drawing air from the room into the plenum chamber, the leading edges of the blades of said fan being axially inwardly spaced from the outer edge of the venturi by a distance within 0.1 to 5 percent of the diameter of the venturi opening, the blades of the fan being at a pitch of between 10 to 60 degrees whereby rotation of the fan between 300 to 400 revolutions per minute causes air intake by the fan to be substantially radially of the venturi; and, refrigerant coils for conveying refrigerant mounted inside said plenum chamber adjacent said outlet aperture whereby air drawn into said plenum chamber is forced across the coils and returns to said room through said outlet aperture.

2. The air circulation system according to claim 1 including a grill mounted adjacent said outlet for directing air flow therethrough downwardly towards the floor of the chamber or room.

3. The air circulation system of claim 1 wherein the ratio of the area of the venturi opening to the area of the outlet aperture defined by said grill is between 1:1 to 1:1.3.

4. The air circulation system of claim 3 wherein the ratio is 1:1.

5. The air circulation system of claim 1 wherein the blades have a pitch of about 40°.

6. The air circulation system of claim 1 wherein:

the clearance of the tip of the blades from the venturi, the axial length of the venturi;

the axial length of the cylindrical portion of the venturi;

the venturi flare radius; and curvature radius of the blades;

expressed as a percentage of the dimension of the opening defined by the venturi are within the ranges 0.0 to 10 percent 5 to 30 percent, 1 to 10 percent, 2 to 20 percent, and 0.1 to 5 percent, respectively.

* * * * *